US005577399A

United States Patent [19]

Whipple, III et al.

[11] Patent Number: 5,577,399

[45] Date of Patent: Nov. 26, 1996

[54] PRESSURE SENSOR FOR APPLIANCE PRODUCTS

[75] Inventors: Walter Whipple, III, Amsterdam; Mark E. Dausch, Latham, both of N.Y.

[73] Assignee: General Electric Company, Schenectady, N.Y.

[21] Appl. No.: 415,970

[22] Filed: Apr. 3, 1995

[51] Int. Cl.[6] ..... D06F 33/02; A47L 15/46

[52] U.S. Cl. ..... 68/12.02; 68/12.14; 68/207; 73/861.47; 134/57 D; 137/387

[58] Field of Search ..... 68/12.02, 12.19, 68/207; 134/57 D, 57 R; 137/386, 387; 73/861.47

[56] References Cited

U.S. PATENT DOCUMENTS

| | | | |
|---|---|---|---|
| 2,408,685 | 10/1946 | Rosenberger | 73/861.47 X |
| 2,612,908 | 10/1952 | Tate et al. | 73/861.47 X |
| 4,555,952 | 12/1985 | Jenkins | 73/861.47 |
| 5,313,964 | 5/1994 | Dausch et al. | 134/57 D |
| 5,408,716 | 4/1995 | Dausch et al. | 8/158 |

*Primary Examiner*—Philip R. Coe
*Attorney, Agent, or Firm*—Donald S. Ingraham

[57] ABSTRACT

A household appliance for washing articles with a cleansing liquid includes a cleansing chamber to receive the articles to be washed; a working fluid distribution system coupled to the cleansing chamber to transfer the cleansing liquid to and from the chamber; a pressure signature sensor disposed in the appliance so as to detect output pressure oscillation of a pump in the working fluid distribution system; and an appliance controller coupled to the working fluid distribution system and responsive to the pressure signature sensor so as to control operation of the pump in correspondence with a pressure oscillation signature generated by the pressure signature sensor. The pressure signature sensor includes a resistive elastomer that is disposed to form a diaphragm with electrodes attached on substantially opposite sides of the diaphragm and which is subject to discharge pressure of the pump. The resistive elastomer material typically comprises a material having a non-specific deflection-resistance relationship such that the signature sensor is a non-calibrated pressure sensor.

8 Claims, 3 Drawing Sheets

PRESSURE SENSOR FOR APPLIANCE PRODUCTS

BACKGROUND OF THE INVENTION

The present invention relates generally to household appliance control systems and associated sensors and in particular to pressure sensors for detecting pressure oscillations in the cleansing liquid used in an appliance such as a dishwasher or clothes washing machine.

One approach to energy use reduction in household appliances such as clothes washers and dishwashers is to optimize the use of water and the time of various cleansing cycles so that effective cleansing is accomplished while minimizing excess time or water used in the process. Commonly these types of household appliances use open loop control systems in which the cleansing liquid (typically water) is introduced into the machine for a predetermined period of time and the machine then operates through various cycles (such as washing, rinsing, and spinning in a clothes washer or washing, rinsing, and drying in a dishwasher) for predetermined periods of time. Such systems of necessity are designed to provide adequate cleaning in worst-case scenarios of large loads of heavily soiled articles; this arrangement frequently involves the use of more cleansing liquid and longer operating cycles than might be required to adequately clean the items in the machine.

One approach to minimizing energy consumption in such appliances has been the incorporation of closed loop control systems in which feedback from sensor measuring selected operating parameters of the machine are used to control operating cycles of the machine. For example, pressure sensors can be used in a wet appliance (that is, an appliance using a cleansing liquid) to generate signals corresponding to pump output pressure and that can be used in such a feedback system to optimize appliance operation. One example of such a control system in disclosed in U.S. Pat. No. 5,313,964, entitled "Fluid-Handling Machine Incorporating a Closed Loop System for Controlling Liquid Load," which is assigned to the assignee herein and incorporated herein by reference.

Pressure sensors of the type suitable for use in a closed feedback control system in household appliances are desirably simple in construction, rugged, long-lasting, and inexpensive to manufacture and install. Further, such pressure sensors typically need to be responsive at relatively low pressures (e.g., pressures of 15 pounds (pounds per square inch differential—psid) or less). Solid state silicon type pressure sensors can provide electrical signals over the low pressure ranges of interest in household appliance operation; such sensors, however, can degrade in the adverse operating environment (e.g., dampness and chemicals commonly used in detergents, such as phosphates, chorine, and the like) to which the household appliance is commonly exposed and further have a cost that effectively makes their use prohibitive in common household appliances.

A need thus exists for a simple, rugged, and inexpensive pressure sensor device that can be incorporated into a closed feedback control system used to improve energy efficiency of household appliances.

SUMMARY OF THE INVENTION

In accordance with this invention, a household appliance for washing articles with a cleansing liquid includes a cleansing chamber to receive the articles to be washed; a working fluid distribution system coupled to the cleansing chamber to transfer the cleansing liquid to and from the chamber, the distribution system having a pump; a pressure signature sensor disposed in the appliance so as to detect output pressure oscillations of the pump; and an appliance controller coupled to the pump and responsive to the pressure signature sensor so as to control operation of the working fluid distribution system (e.g., control of the pump or control valves in the system) in correspondence with a pressure oscillation signature generated by the pressure signature sensor.

The pressure signature sensor includes a resistive elastomer that is disposed to form a diaphragm with electrodes attached on substantially opposite sides of the diaphragm; the electrical resistance of the resistive elastomer material corresponds to the spatial deflection of the diaphragm. The pressure signature sensor is disposed in a spaced relation to the pump such that cleansing liquid in the device so that the discharge pressure of the pump impinges on the sensor, resulting in spatial deflection of the resistive elastomer material in correspondence with the magnitude of the pressure oscillations. The resistive elastomer material typically comprises a material having a non-specific deflection-resistance relationship and the signature sensor typically is a non-calibrated pressure sensor.

BRIEF DESCRIPTION OF THE DRAWINGS

The features of the invention believed to be novel are set forth with particularity in the appended claims. The invention itself, however, both as to organization and method of operation, together with further objects and advantages thereof, may best be understood by reference to the following description in conjunction with the accompanying drawings in which like characters represent like parts throughout the drawings, and in which:

DETAILED DESCRIPTION OF THE INVENTION

Figure 1:
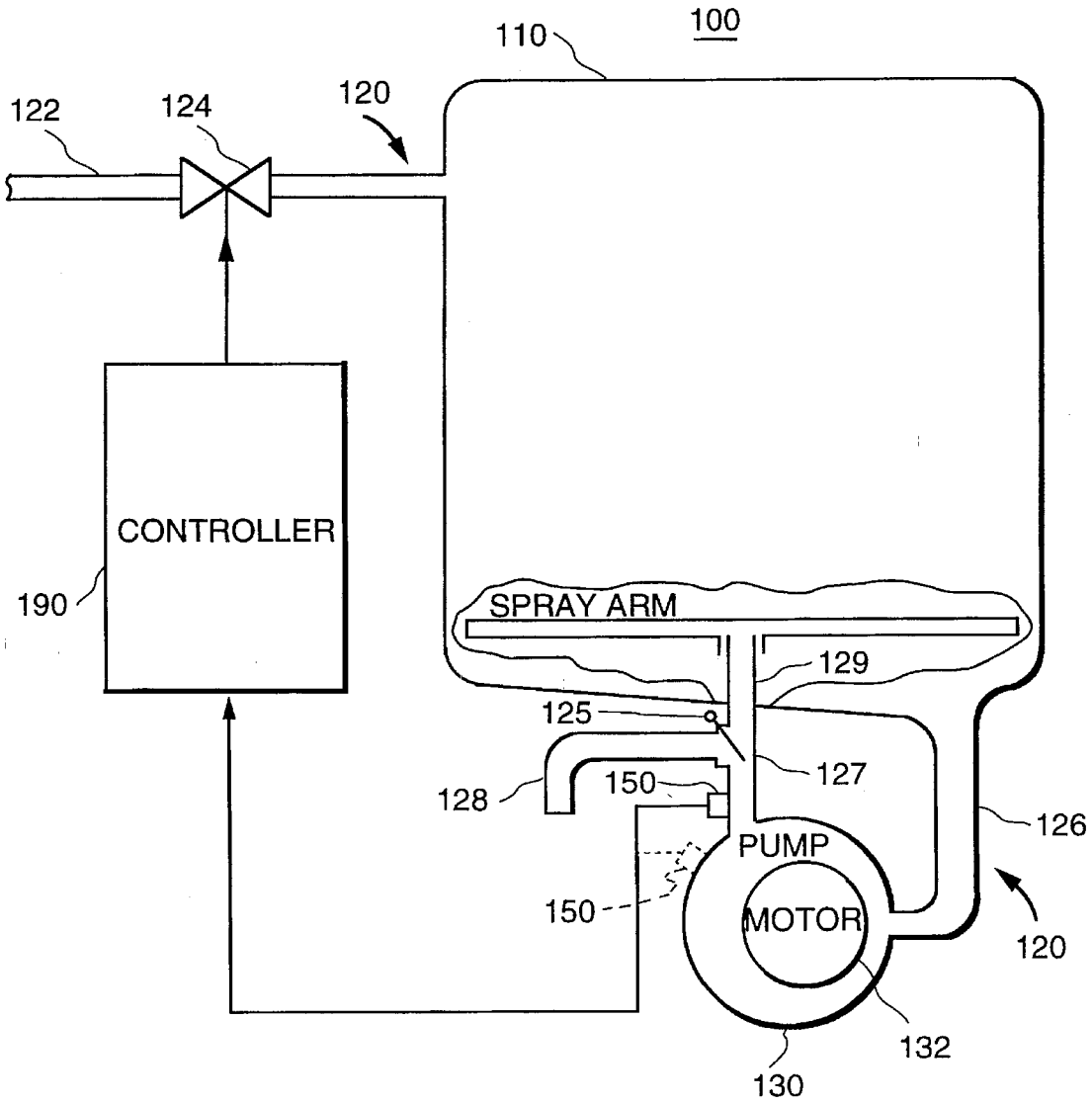
FIG. 1 is a partial block diagram and partial schematic diagram of a household appliance having a pressure signature sensor in accordance with this invention.

A household appliance 100 in accordance with this invention comprises a chamber 110, a working fluid distribution system 120 coupled to chamber 110, and a controller 190 coupled to control operation of working fluid distribution system 120. Household appliance 100 typically comprises a machine for cleansing articles, such as fabric items (e.g., a washing machine for washing items made from natural and synthetic fibers, or combinations thereof, such as clothes and the like) or food handling items (e.g., a dishwasher). In such machines, the working fluid is a cleansing liquid such as water; as used herein, the term "cleansing liquid" and the like typically refer to a water and mixtures of water and detergents. By way of example and not limitation for describing this invention, appliance 100 illustrated in FIG. 1 represents a dishwasher.

Chamber 110 is adapted to receive food handling items (dishes, pots and the like) for cleansing, and is coupled to working fluid distribution system 120 so that the cleansing liquid can be transferred into and out of cleansing chamber 110. Working fluid distribution system 120 typically comprises a cleansing liquid supply line 122 having a control valve 124 disposed therein and that is responsive to controller 190 to govern admittance of the cleansing fluid to cleansing chamber 110. Fluid distribution system 120 further comprises a pump 130 coupled to cleansing chamber 110 via suction piping 126 and discharge piping 127. As illustrated in FIG. 1, in one embodiment of a dishwasher, discharge piping 127 comprises a spray arm line 129 in chamber 110, and an outlet (or drain) line 128. Liquid discharged from pump 130 is directed between spray arm line 129 and drain line 128 by a control valve 125 disposed in discharge piping 127; typically control valve 125 is a solenoid valve that is coupled to and responsive to control signals generated by controller 190.

Pump 130 typically comprises an electric motor 132 that is coupled to and responsive to signals from controller 190 that energize or de-energize the motor, or alternatively, additionally control the speed of motor 132. Pump 130 typically comprises a centrifugal type of pump having a relatively low discharge pressure, that is not greater than about 15 pounds per square inch (psid), and commonly in the range between zero and about 6 pounds (psid). In operation, the discharge pressure of the pump frequently oscillates as the pump periodically loses suction due to sporadic flow of the cleansing liquid from chamber 110 through suction piping 126 (e.g., when air is mixed with water draining from chamber 110).

In accordance with this invention, appliance 100 further comprises a pressure signature sensor 150 that is coupled to working fluid distribution system 120 so as to be exposed to pressure oscillations at the output of pump 130. Pressure signature sensor 150 is further electrically coupled to controller 190 to provide an electrical signal to the controller that corresponds to the pressure signature detected by sensor 150. Sensor 150 is coupled to discharge piping 127, or alternatively, sensor 150 is mounted on the housing of pump 130 (this arrangement illustrated in phantom in FIG. 1).

Figure 2A:
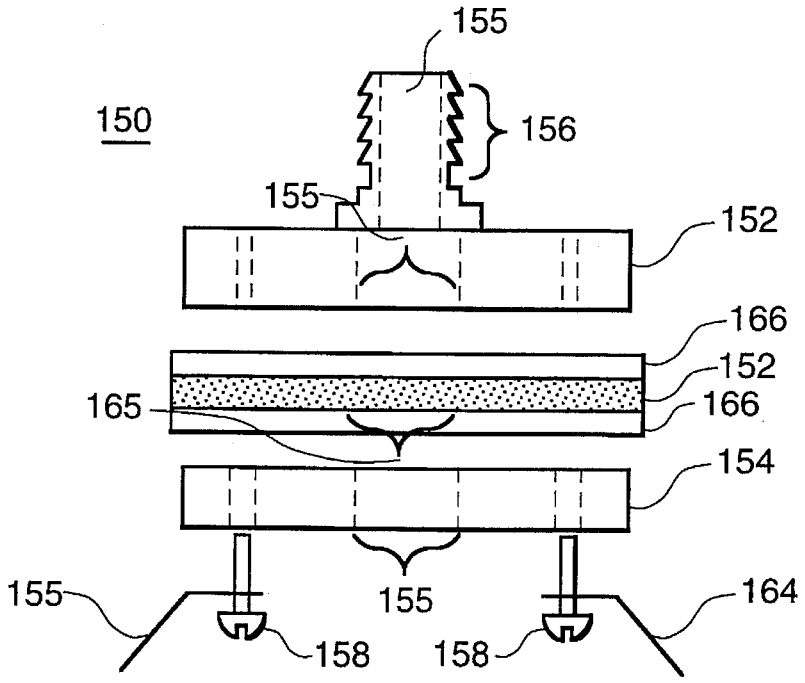
FIG. 2(A)is a side view of a pressure signature sensor in accordance with one embodiment of the present invention.
Figure 2B:
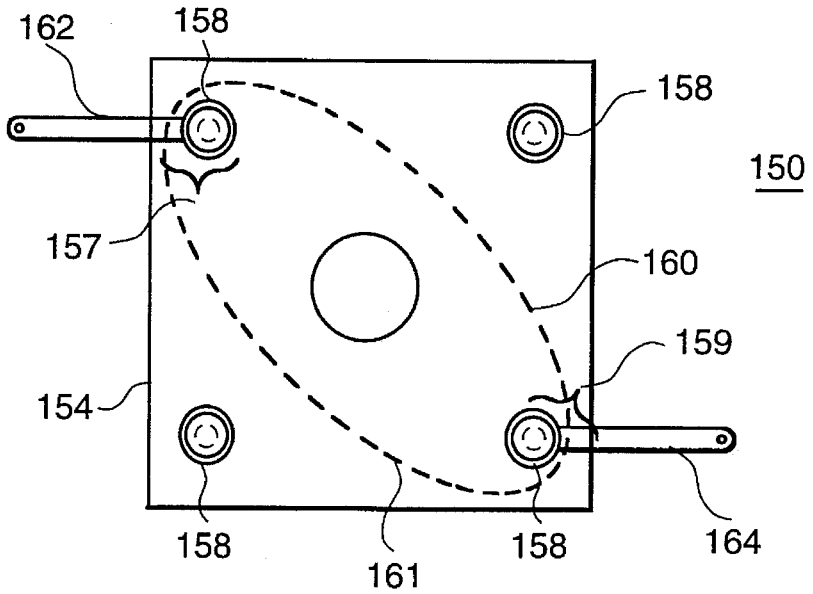
FIG. 2(B) is a bottom view of a pressure signature sensor in accordance with one embodiment of the present invention.

Pressure signal sensor 150 comprises a first non-conductive housing member 152, a second non-conductive housing member 154 and a resistive elastomer material 160 disposed therebetween as illustrated in FIGS. 2(A) and 2(B). First housing member further comprises a fitting 156 adapted for coupling the sensor to discharge piping 127 (FIG. 1); alternatively, first housing member may comprise a non-conductive portion of the housing of pump 130, typically at the output (or discharge) plenum of the pump (not separately illustrated). First housing member 152 further comprises a sensing channel 155 disposed therein so as to allow fluid communication between working fluid distribution system 120 and a diaphragm 165 (FIGS. 2(A) and 2(B), the diaphragm comprising the portion of resistive elastomer material 160 disposed across sensing channel 155. Second housing member 154 further comprises a corresponding channel 155. The size (e.g., inner diameter of a cylindrical-shaped channel) of sensing channel 155 allows sufficient fluid communication between discharge piping 127 and diaphragm 165 such that pressure oscillations at the discharge of pump 130 are communicated to diaphragm 165 coincident with the pump discharge pressure excursions. The size of channel 155 can further be chosen to provide some filtering of undesired machine noise, such as a 60 Hz component (typically, the pressure oscillations of interest as described herein are typically in the range of 1–5 Hz). Sensor 150 further comprises a first electrical contact 162 and a second electrical contact 164 electrically coupled to resistive elastomer 160 so as to measure the electrical resistance of resistive elastomer across diaphragm 165.

Resistive elastomer material 160 comprises an elastomeric material having conductive particles mixed therein so that the material is electrically conductive. The resistance between two contact points on material 160 is a function of the spatial deflection of the material between the two points; thus, a change in electrical resistance corresponds to a change of spatial deflection of the resistive elastomer material. As used herein, "spatial deflection" and the like refers to stretching or contracting displacement of resistive elastomer material 160. Resistive elastomer material typically has a "neutral position," that is, the physical shape to which it returns when not subject to any differential pressure (such as when appliance 100 is not operating); deflection from the neutral position is caused by pump pressure excursions, with attendant changes in the electrical resistance of the material between the two electrical contact points. For example, elongation (e.g., stretching) of material 160 between two electrical contact points causes the resistance of the resistive elastomer material to increase; conversely, contraction (or shrinkage) of the resistive elastomer material results in a decrease of the electrical resistance between the two contact points. The elastomer material typically comprises butadiene, elastomers prepared from silicone type rubbers, or the like. The conductive particles mixed into the elastomer material typically comprise carbon, nickel, silver, gold, or the like. One example of a resistive elastomer material is mixture of silicone and carbon, one type of which is part number SC-CONSIL 861 available from the Technit Company of Cranford, N.J.

In accordance with this invention, resistive elastomer 160 in sensor 150 is a material having a non-specific resistance-deflection relationship. That is, the elastomer material exhibits the characteristics of a change in electrical resistance in response to spatial deflection of the material but the magnitude of the change in the material's electrical resistance for a given spatial deflection is not critical to the functioning of sensor 150. Thus, sensor 150 is a non-calibrated sensor, that is, a sensor that does not need provide a particular electrical resistance value (e.g., a calibrated or standard value) for a given pressure applied (e.g., a pressure that causes spatial deflection of the material). The electrical resistance does, however, correspond to the amount of spatial deflection. Thus, sensor 150 need not provide a calibrated output in which the electrical signal arising from a particular spatial deflection is processed to determine a corresponding pressure value, but rather generates an output that provides an electrical signature of the pressure oscillations incident on diaphragm 165. This electrical signature signal comprises a feedback signal processed by controller 190 for control of the appliance, as discussed below. As sensor 150 provides an electrical signature of pressure oscillations rather than calibrated pressure values, the sensors are readily and inexpensively fabricated because variation between respective sensors in the magnitude of electrical resistance change for corresponding pressure inputs is acceptable and no separate calibration is required for each sensor prior to installation in the appliance.

Resistive elastomer 160 typically further comprises a non conductive interface layer 166 that is disposed at least on the surface of resistive elastomer 160 that is exposed to the working fluid of appliance 100 in diaphragm 165; commonly interface layer 166 is disposed on both sides of resistive elastomer diaphragm 165. Non-conductive interface layer 166 typically comprises an elastomeric material (e.g., a thermoplastic elastomer such as Santoprene, available from Advanced Elastomers of St. Louis, Mo., or the like) that is disposed in intimate contact with the resistive elastomer material so as to form a monolithic piece of material. Interface layer 166 has a thickness sufficient to electrically insulate the resistive elastomer material from any electrically conductive working fluids incident on diaphragm 165 and to electrically isolate the diaphragm for the safety of operators of the appliance.

One embodiment of pressure signature sensor 150 is illustrated in FIGS. 2(A) and 2(B). In a common household dishwasher, for example, pressure signature sensor comprises a sensing channel having an inner diameter of about 10 mm and a diaphragm 165 having a diameter of about 20 mm. Resistive elastomer material as described above is disposed between first and second housing members 152, 154 and has a thickness of about 1 mm. By way of example and not limitation, this resistive elastomer material (as described above) has a resistivity of about 150 Ω/sq.; for the arrangement described herein, in the neutral position (zero psid across the diaphragm), the sensor has an impedance of about 270 Ω; with a five pound pressure applied (5 psid), the impedance of the sensor increases to about 287 Ω.

First and second housing members 152, 154 comprise plastic or the like, and are held together by fasteners 158. Resistive elastomer 160 has an oblong type or diamond shape 161 (shown in phantom in FIG. 2(B)) extending between a first fastener contact point 157 and a second fastener contact point 159 which are disposed on opposite sides of diaphragm 165. Fasteners 158 each typically comprise a conductive material (e.g., metal screws, rivets, wire, or the like), which are disposed through housing members 152, 154 so as to be electrically coupled to resistive elastomer 160. First and second electrical contacts 162, 164 respectively comprise the fasteners disposed in first and second contact points 157, 159. Diaphragm 165 is thus disposed so as to be exposed to the working fluid of appliance 100 via sensing channel 155 in first housing member 152. A corresponding portion of sensing channel 155 is disposed in second housing member 154 such that diaphragm 165 can be spatially deflected, or stretched, into the region of the sensing channel in second housing member 154 in response to pressure exerted by the working fluid. The portion of sensing channel 155 in second housing member 154 is typically vented to atmosphere.

Figure 3:
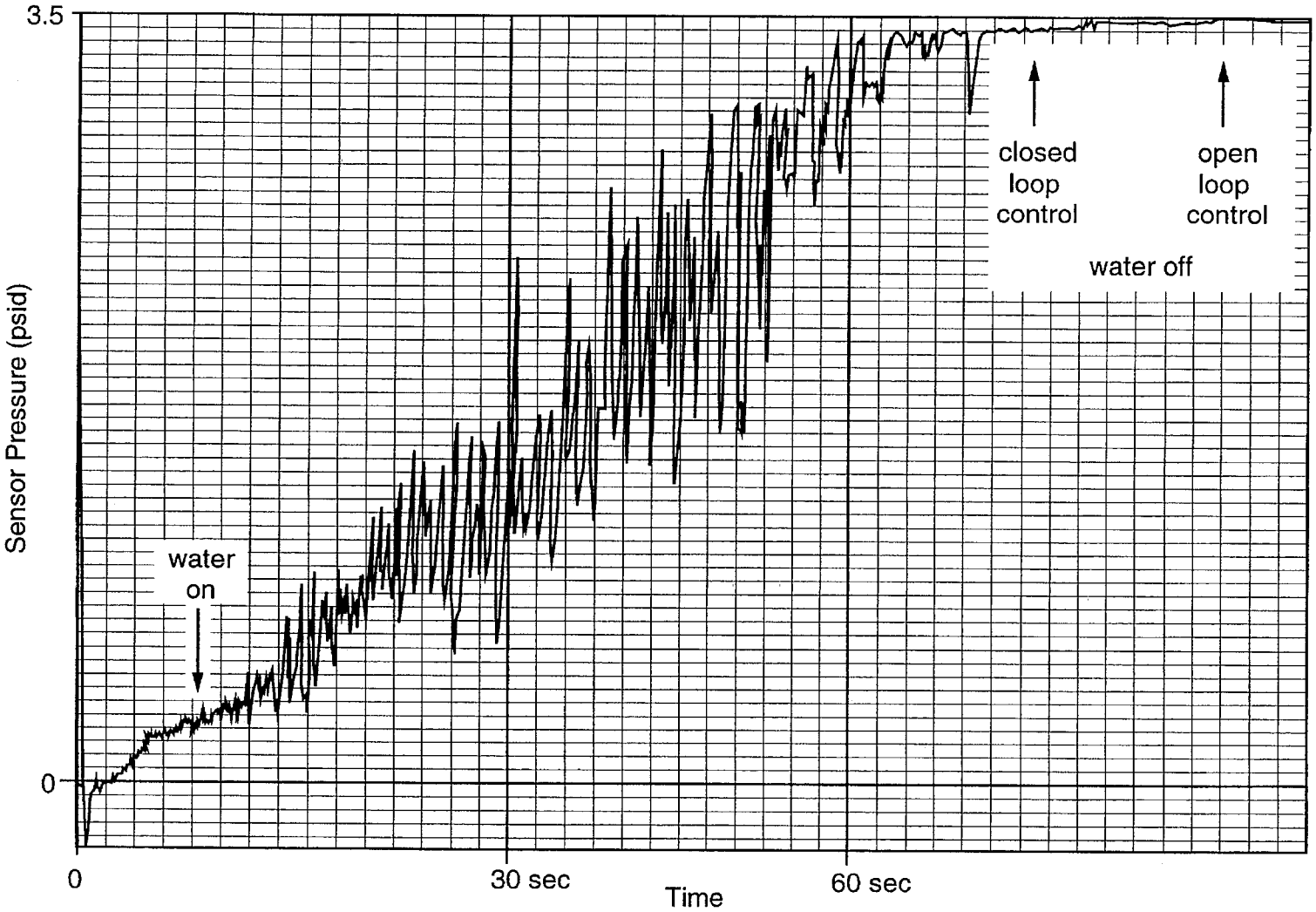
FIG. 3 is a plot of liquid pressure oscillations versus time in a household appliance having a pressure signature sensor in accordance with this invention.

Pressure signal sensor is electrically coupled to controller 190 such that an electrical signal corresponding to pressure oscillations of the working fluid are passed to controller 190. For example, changes in voltage, or alternatively, current, resulting from the chance in resistance of diaphragm 165 as it is spatially deflected (e.g., stretches and contracts) by the incident pressure pulses of the working fluid discharged from pump 130 provide the desired electrical signature. A representative graphic representation of the electrical signature of pump discharge pressure oscillations is shown in FIG. 3. This figure depicts the voltage (as measured in a single active element half-bridge) from sensor 150 as a function of time in a dishwasher fill cycle. At start time point 300 water addition to chamber 110 (FIG. 1) is begun via control valve 124. At this time pump 130 is energized and draws a suction on line 126 to pump the water into a spray arm in chamber 110. During the fill process, pump discharge pressure oscillates, as illustrated by the high and low peaks along the ramping curve of the electrical sensor signal corresponding to pump discharge pressure in FIG. 3. When the pressure oscillations cease, as shown at time point 350, there is sufficient water in the dishwasher for articles loaded to be cleaned for the pump to recirculate back into the chamber (e.g., via the spray arm).

Controller 190 typically comprises a closed loop feedback control processor (not separately illustrated) for processing the pressure signature illustrated in FIG. 3. The feedback control processor typically comprises a microprocessor, a microcontroller, an application specific integrated circuit (ASIC), a digital signal processor (DSP) or similar processor that is programmable with a desired processing algorithm. The absence of pressure oscillations as detected by sensor 150 over a predetermined time period (e.g., about 1 minute for a dishwasher) enables the controller to generate a control signal to close control valve 124 to stop the addition of cleansing liquid to chamber 110. The closed loop feedback system of controller 190 typically provides a saving over an open loop (e.g., timed) addition of water, as illustrated by time point 375, which represents the time at which a conventional open loop control system secures the flow of cleansing liquid into chamber 110 under analogous load conditions. Characteristic pressure signatures can be seen during pumpout of the cleansing liquid in chamber 110; for example, at the endpoint of the pumping cycle in draining a dishwasher pumpout cycle, pressure drops rapidly to a low level when chamber 110 has been drained. Controller 190 is adapted to generate a control signal to secure pump 130, thereby not running the pump in the drain cycle any longer than is necessary to purge chamber 110 of the cleansing fluid. The pressure signature in the pumpout cycle of a clothes washer is different than that of a dishwasher, and it is common in a clothes washer drain cycle to observe a characteristic series of pressure oscillations as the pump nears the endpoint of that cycle.

The flat portion Of the pressure oscillation signature (e.g., as illustrated at time point 350 in FIG. 3) generated by sensor 150 when chamber 110 has been filled comprises a fluid distribution system cycle endpoint. Controller 190 typically further comprises an algorithm by which the controller is adapted to a particular non-calibrated sensor 150 though the operation of one or more test cycles. Any sensor 150 adapted for use in a given type of appliance can be installed and test run; controller 190 adapts to the magnitude of the pressure oscillation electrical signals that is peculiar to the particular sensor 150 installed in that machine. Thus, programming of controller 190 obviates the need for multiple sensors 150 to have a uniform, calibrated output value so long as the respective sensors provide the signature of the pressure oscillations.

Alternatively, appliance 100 comprises a clothes washing machine in which pressure signature sensor 150 can be advantageously used to provide signals for the closed loop feedback controller 190 to generate signals to control operation of the pump for supplying or draining the cleansing liquid from the system. For example, in the spin cycle of a clothes washer, pump discharge pressure oscillates as water is extracted from the clothes being spun; thus, an appropriate pressure signature can be used in controller 190 to determine an optimum operation cycle for operating the pump to effectively drain the water (e.g., periodic operation of the pump when sufficient water is available to be pumped, thereby increasing efficiency and reducing noise, and to determine the end to the spin cycle).

While only certain features of the invention have been illustrated and described herein, many modifications and changes will occur to those skilled in the art. It is, therefore, to be understood that the appended claims are intended to cover all such modifications and changes as fall within the true spirit of the invention.

What is claimed is:

1. A household appliance for washing articles with a cleansing liquid, comprising:

a cleansing chamber adapted to receive the articles to be washed;

a working fluid distribution system coupled to said cleansing chamber for transferring said cleansing liquid to and from said chamber, said distribution system comprising a pump;

a pressure signature sensor disposed in said appliance so as to detect output pressure oscillations of said pump; and an appliance controller responsive to said pressure signature sensor so as to control operation of said working fluid distribution system in correspondence with a pressure oscillation signature generated by said pressure signature sensor;

said pressure signature sensor comprising a resistive elastomer material disposed between a first and a second electrical contact, the resistance of said resistive elastomer material corresponding to the spatial deflection of said elastomer material, said pressure signature sensor further being disposed in said appliance in a spaced relation to said pump such that liquid subject to the discharge pressure of said pump impinges on said sensor so that pump discharge pressure oscillations impart spatial deflections of said resistive elastomer material in correspondence with the magnitude of the pressure oscillations.

2. The appliance of claim 1 wherein said resistive elastomer material comprises a diaphragm in said pressure signature sensor, said diaphragm being disposed such that one side of said diaphragm is coupled through said cleansing liquid to receive the pump discharge pressure oscillations.

3. The appliance of claim 2 wherein said pressure signature sensor is mounted on said pump.

4. The control system of claim 1 wherein said resistive elastomer material comprises a material having a non-specific resistance-deflection relationship.

5. The appliance of claim 4 wherein said pressure signature sensor is a non-calibrated sensor.

6. The appliance of claim 1 wherein said appliance controller comprises a closed loop feedback system adapted to process said pressure oscillation signature generated by said pressure signature sensor so as to generate a working fluid distribution control signal following a predetermined decrease in the magnitude of respective pressure oscillations in said pressure oscillation signature.

7. The appliance controller of claim 6 wherein said appliance controller is further adapted to a respective pressure signature sensor disposed in said appliance such that the magnitude of generated electrical signals peculiar to said respective pressure signature sensor in response to a pressure oscillation signature corresponding to working fluid distribution system cycle endpoints is stored in said controller.

8. The appliance of claim 1 wherein said appliance is selected from the group consisting of washing machines for fabric items and washing machines for food handling items.

* * * * *